US005580005A

United States Patent [19]

Meyer et al.

[11] Patent Number: 5,580,005

[45] Date of Patent: Dec. 3, 1996

[54] ARRANGEMENT FOR CRUSHING AND COOLING MATERIAL PASSING OUT OF A FIRING OVEN

[75] Inventors: Hartmut Meyer, Buxtehude; Günther Koeberer, Hamburg, both of Germany

[73] Assignee: Claudius Peters Aktiengesellschaft, Buxtehude, Germany

[21] Appl. No.: 335,887

[22] PCT Filed: Mar. 18, 1994

[86] PCT No.: PCT/EP94/00855

§ 371 Date: Nov. 15, 1994

§ 102(e) Date: Nov. 15, 1994

[87] PCT Pub. No.: WO94/21381

PCT Pub. Date: Sep. 29, 1994

[30] Foreign Application Priority Data

Mar. 19, 1993 [DE] Germany ..... 9304122 U

[51] Int. Cl.[6] ..... B02C 4/28

[52] U.S. Cl. ..... 241/65; 241/285.1; 110/232

[58] Field of Search ..... 110/232; 241/65, 241/285.2, 286, 285.1, 230, 231

[56] References Cited

U.S. PATENT DOCUMENTS

| | | | |
|---|---|---|---|
| 2,539,775 | 1/1951 | Gordon | 241/285.2 |
| 3,633,889 | 1/1972 | Beckum et al. . | |
| 4,133,693 | 1/1979 | Nudelman et al. . | |
| 4,630,781 | 12/1986 | Brown et al. | 241/285.2 |

FOREIGN PATENT DOCUMENTS

| | | | |
|---|---|---|---|
| 0313726 | 5/1989 | European Pat. Off. . | |
| 926338 | 4/1955 | Germany . | |
| 928138 | 5/1955 | Germany . | |
| 1057417 | 5/1959 | Germany | 241/285.2 |
| 2747732A1 | 12/1978 | Germany . | |
| WO92/21441 | 12/1992 | WIPO . | |

*Primary Examiner*—Mark Rosenbaum

*Attorney, Agent, or Firm*—Chilton, Alix & Van Kirk

[57] ABSTRACT

Arrangement for crushing and cooling the material passing out of a firing oven, wherein the crusher is arranged in the hot region, preferably immediately following the oven, in the path of the material upstream of the cooler. According to the invention the crusher comprises a plurality of roll-like crushing elements which are mounted overhung and which project into the path of the material from outside said path and for maintenance purposes are retractable therefrom.

12 Claims, 3 Drawing Sheets

ARRANGEMENT FOR CRUSHING AND COOLING MATERIAL PASSING OUT OF A FIRING OVEN

Figure 1:
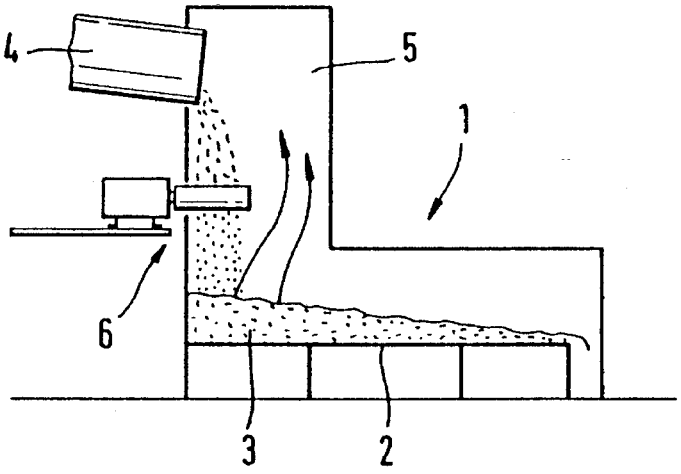

The smaller and more uniform the particle size of fired material, the more quickly and uniformly it can be cooled. This has a favorable effect on the size of the cooler and the quality of the product. For the purpose of comminuting the fired material the arrangement of a crusher immediately following the oven, upstream of the cooler, has therefore already been considered. For this purpose preference is given on the one hand to crushers working at high speed and permitting passage without cooling air, such as percussion rebound crushers (DE A 29 25 665, DE C 33 23 565, FR A 2 194 133) and on the other hand jaw crushers (WO 92 21 441). Comminution on rolls is also considered (DE B 27 47 732), without it being known in detail how this is to be achieved. In all cases it must be expected that a crusher working in the hot region between the oven and the cooler, at temperatures between 1000° and 1500°, will require considerable maintenance work, which can be done only at ambient temperature and therefore require the removal of the crusher from the hot region. This requirement is all the more difficult to meet, the larger the crusher. This would at first glance speak in favor of high-speed and correspondingly smaller crushers and against low-speed, heavy types of crushers, such as jaw crushers and roll crushers.

The invention has however realized that the maintenance problem can be particularly easily solved by using a crusher which, after the style of a roll crusher, comprises a plurality of roll-like crushing elements, provided that the latter are according to the invention mounted overhung outside the path of the material and project retractably into the path of the material.

This arrangement has on the one hand the advantage that the bearing devices, as such, are not subjected to the high temperature of the working region. Consequently, less maintenance is required for the bearing devices, and the maintenance can in fact often be carried out even without interrupting operation. If the crushing elements themselves require maintenance, they can simply be retracted individually together with their bearing device and be serviced or replaced. Since the entire crusher is composed of a plurality of roll-like crushing elements, the operation of only a part of the crusher is then interrupted, and such an interruption is therefore tolerable in many cases. In addition, appropriate selection of the direction of rotation of the crushing elements adjacent to the retracted crushing element makes it possible to ensure that as little material as possible falls through the gap in the crusher caused by the retraction of this crushing element. If the falling-through of part of the uncrushed fired material is not to be tolerated, it is also possible to cover the crushing element to be serviced with a bridging element before it is retracted, the bridging element, which for example may have a roof-shaped configuration, diverting the fired material to the adjoining crushing elements.

The roll-like crushing elements may be customary crushing rolls, such as are known in roll crushers. However, since the material to be crushed which comes from the oven is not as a rule hard and brittle, as is the case for the usual field of application of roll crushers, but is doughy and viscous to crumbly, the crushing elements may also have a different configuration to suit the specific nature of the material to be crushed. They may for example be smooth or have radially projecting barbs or cutting edges engaging in one another.

In the context of the invention it is important that, from whichever side they may project into the region of the material, the roll-like elements together cover a cross-sectional area covering the entire region within which the presence of material to be crushed is to be expected. As a rule this will be the entire cross-sectional area in which the material is passed from the oven to the cooler, that is to say for example in which it falls from the ejection opening of a rotary tubular oven. If, however, the presence of coarse material must be expected in only a part of the entire cross-section through which the material passes, it is sufficient to provide the rolls in that partial region. This may be the case when use is made of rotary tubular ovens in which the coarse material falls preferentially on one side. Similarly, this may be the case where interposed sieves or the like separate the fine material from the coarse material which is to be crushed, and only the latter is passed to the crusher. The principle of the invention therefore includes the arrangement of a larger part of the crushing elements on that side of the cooler inlet shaft on which the oversize particles to be crushed predominantly occur. The path of the material on which the crushing elements are situated, and which for example may be formed by the inlet shaft of the cooler, is separated by a partition or shield from the region in which the bearing devices for the crushing elements are situated. Said partition or shield has openings of adequate size for the axial passage of the crushing elements. It is not necessary for these openings to be continuously open to the size necessary during the insertion of the crushing elements into the path of the material or during the retraction of said elements. On the contrary, filling pieces may be provided, which during operation close the cross-section of the opening to the size of the circumference of the crushing element or of a shaft carrying the crushing element.

The bearing devices are provided with devices for moving the crushing elements in the longitudinal direction, for example by means of rollers and rails. Rails or other conveyor means may be connected, which permit rapid removal of a damaged unit and installation of a replacement unit. Each unit comprising a crushing element and a bearing device expediently also includes the appertaining drive consisting of a motor and a gear set, so that in the event of the interruption of operation with one crushing element the down time is not increased by the need also to carry out special connection work before retraction or after introduction.

The inclination of the crushing elements relative to the horizontal direction is expediently adjustable, preferably during operation. On the one hand, uniform distribution of the material to be crushed over the length of the crushing elements can thereby be assisted, and on the other hand the overflowing of uncrushed material at the ends of the crushing elements can be avoided. Adjustability of the crushing elements in their longitudinal direction can also be helpful in this respect. This adjustability can easily be achieved in that the crushing elements project to a greater or lesser extent into the path of the material.

Finally, the crushing elements can also be movable in their transverse direction. This can on the one hand serve to adjust the crusher nip in the sense that different transverse positions of the crushers can be adjusted and fixed. It can also be used to widen the crushing nip temporarily in order to allow large, hard objects to pass through. This widening can be a passive yielding movement which because of the resistance to crushing of the foreign body takes place against a resilient force (spring or pneumatic force or the like). It may also be actively controlled. If only a pair of crushing rolls or the outermost rolls of a group of rolls are affected, the yielding movement may be provided in the horizontal direction. In the case of a crushing roll arranged between other crushing rolls the widening of one crushing nip would lead to loads on the other, which often is impermissible. In these cases the yielding movement may be provided in the vertical direction.

As a rule the proportion of coarse and oversize particles to be subjected to the crushing action is relatively low, namely under 10%. By far the greater part of the material falls through uncrushed between the crushing elements. Having regard to the wear of the crushing elements and the structure of the material to be crushed, it is therefore preferably possible to be satisfied with a relatively low speed of rotation of the crushing elements, which as a rule is below 100 $min^{-1}$ rotations per minute and preferably below 30 $min^{-1}$ rotations per minute. However, the speed of rotation of the crushing rolls is expediently adjustable, preferably independently of one another, in order that the operation of the crusher can be adapted to individual properties of the material. It should therefore be possible to increase the speed of rotation considerably above the normal speed range, for example up to approximately 200 $min^{-1}$ rotations per minute. The direction of rotation of the rolls is also expediently reversible, because the distribution of the material discharged from the oven over the individual crushing rolls, and therefore also over the width of the cooler bed situated under them, can thereby be influenced.

Whereas with other types of crushers it may be desirable for the heated cooling air, which comes from the cooler and is to be fed as secondary air to the oven, to be passed through the cooler to the greatest possible extent, in the case of the crusher according to the invention this is not as a rule desired, because it may hinder the movement of the material through the crusher. Instead, provision may be made for the crushing elements to be provided only in a part of the cross-section of the path of the material, while the other part for the flow of cooling air from the cooler to the oven is free from crushing elements.

Figure 2:
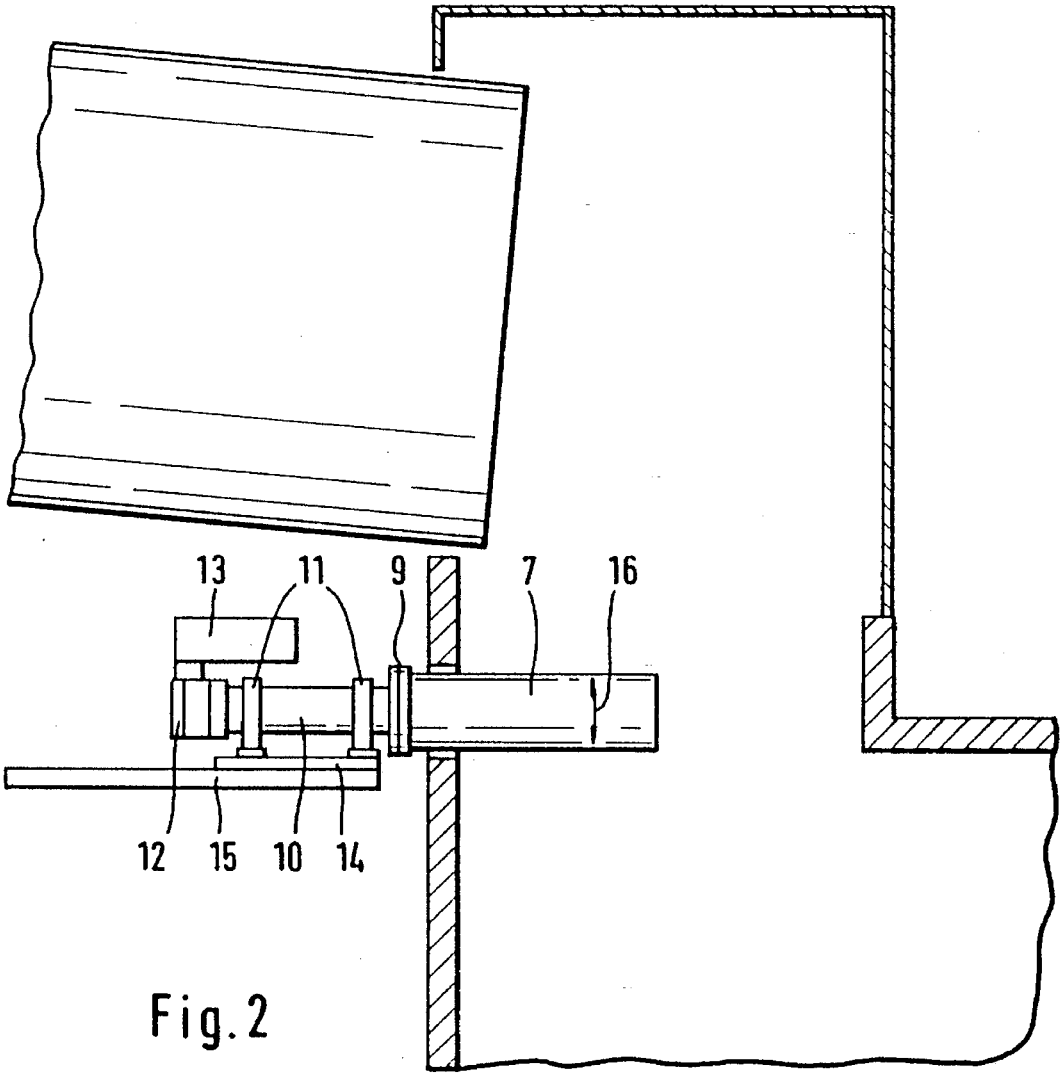
Figure 5:
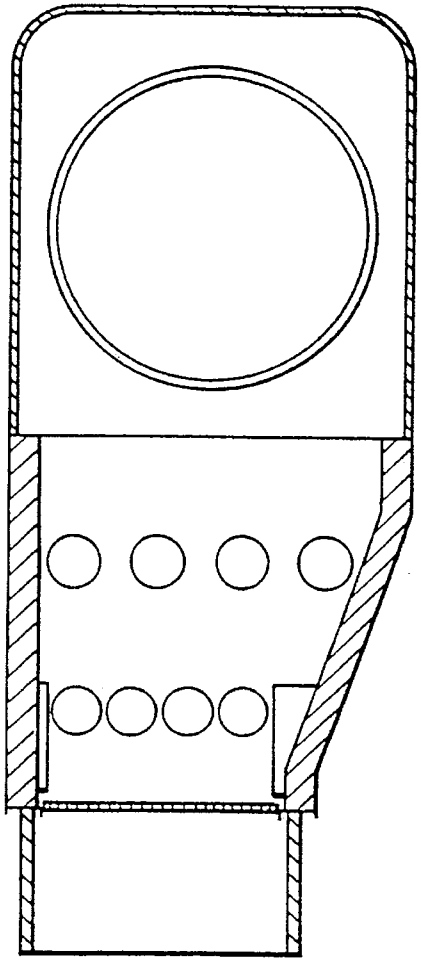
Figure 4:
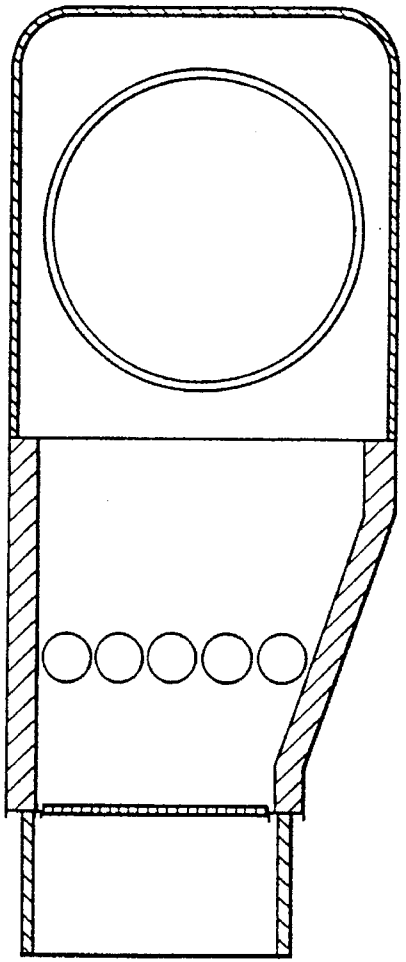
Figure 3:
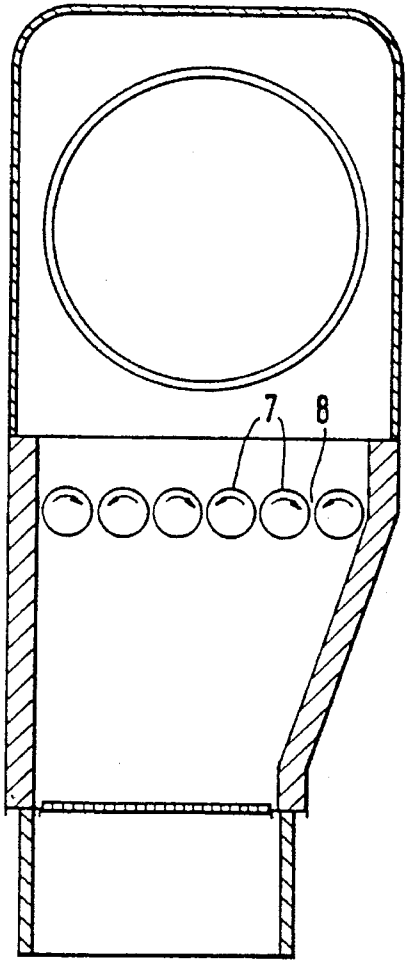
Figure 7:
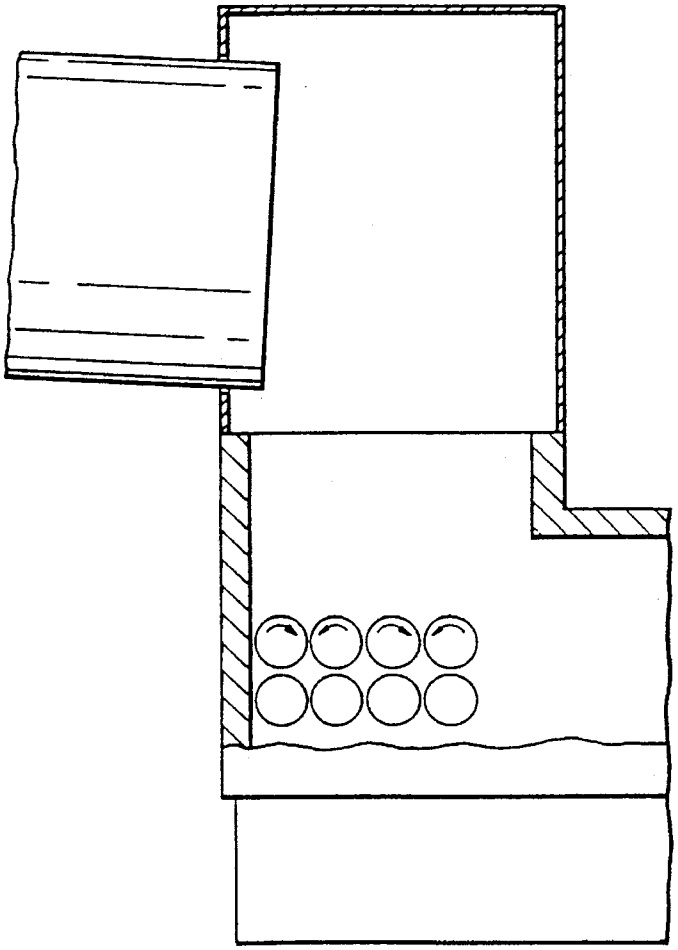
Figure 6:
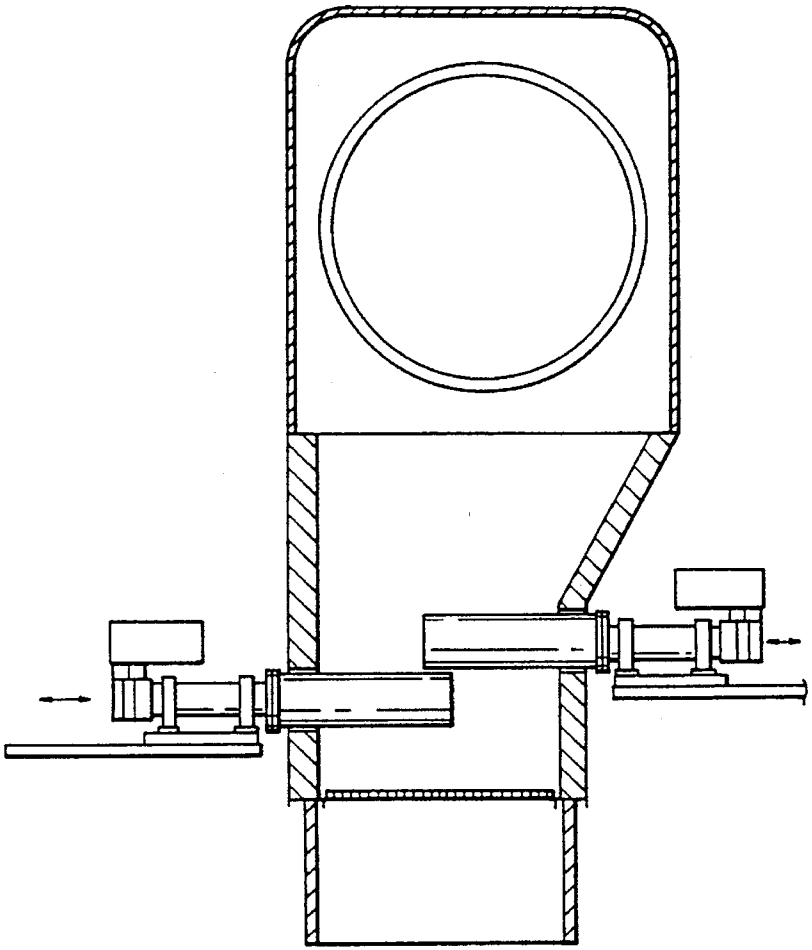

The invention is explained more fully below with reference to the drawing, which schematically illustrates advantageous exemplary embodiments and in which:

FIG. 1 shows a longitudinal section through an arrangement according to the invention, FIG. 2 shows a longitudinal section through the crusher region on a larger scale, FIGS. 3, 4 and 5 show cross-sections of different crusher arrangements, and FIGS. 6 and 7 show a longitudinal section and a cross-section through another embodiment.

FIG. 1 shows a clinker cooler 1 having a cooling grate 2, on which the bed 3 of material to be cooled moves in the direction of the arrow. Upstream of the cooler is disposed a rotary tubular oven 4, the discharge end of which leads into the inlet shaft 5 of the cooler and ejects the fired material in that region of the inlet shaft 5 which is shown on the left in the drawing, whereas in the free, right-hand region the air which has passed through the cooler flows, as indicated by arrows, as secondary air to the rotary tubular oven 4.

The crusher, which is given the general reference numeral 6, is situated in that region of the inlet shaft 5 in which the material is ejected.

As can be seen in FIG. 2, the crusher 6 comprises a plurality of crushing rolls 7, which are arranged side by side, together filling the entire cross-section of the ejection region of the inlet shaft 5, while in each case a roll nip 8, the size of which is determined by the desired particle size of the fired material, is left free between them. In the firing of cement clinker, for example, 95% of the fired material is obtained with the desired fine particle size below 25 mm. Another 5% is composed of coarse particles (25 to 100 mm) and oversize particles (above 100 mm). The coarse and oversize particles have to be crushed to the desired dimensions, while the greater part of the particles can pass through uncrushed.

Each crushing roll 7 is held by means of a flange connection 9 on a crusher shaft 10 mounted overhung by a bearing device 11 forming a single unit with the gear set 12 and motor 13 on the machine frame 14. The frame 14 is provided with suitable devices enabling it to be displaced in the longitudinal direction of the crushing roll 7 on a pair of rails 15, specifically at least so far that the crushing roll can on the one hand assume, inside the inlet shaft 5, the operating position shown in FIG. 2 and on the other hand be completely drawn back out of said shaft for the purpose of maintenance or replacement on the platform on which the rails 15 are provided.

The ability of the unit to travel along the rails 15 also makes it possible to determine appropriately the longitudinal adjustment of the crushing roll 7 within the inlet region 5. In addition, devices can be provided which enable the inclination of the crushing roll relative to the horizontal direction to be adjusted in accordance with the arrow 16, in order thereby to influence the longitudinal distribution of the material on the crushing roll.

The direction of rotation of the crushing rolls can for example be selected as indicated by arrows in FIG. 3, whereby three pairs of crushing rolls are formed, each pair together forming a crushing nip. However, the direction of rotation may also be selected to differ therefrom, particularly in order to influence the distribution of the material to be crushed over the crushing rolls or on the cooler bed situated beneath them. For the same purpose, use may also be made of different control of the speed of rotation of the individual crushing rolls. The direction of rotation can also be regularly changed.

FIG. 4 shows a crushing roll arrangement which is similar to FIG. 3, but in which the rolls are arranged in a lower plane and are fewer in number in accordance with the narrowing of the inlet shaft.

According to FIG. 5 two rows of crushing rolls, arranged one above the other, are provided, the top row having wider spacing of the rolls in order to precrush very large pieces, which are then further comminuted in the lower plane. For the purpose of adaptation to varying operating conditions, the spacing of the rolls in the top row may be adjustable.

FIGS. 6 and 7 illustrate an embodiment in which the crushing rolls project from opposite sides into the inlet shaft. A relatively large cross-sectional area and cross-sectional width can thus be covered with crushing elements whose effective length corresponds approximately to only half the cross-sectional width which is to be covered.

The crushing rolls are acted on from the inside by a liquid or gaseous cooling medium, which keeps them at a beneficial temperature. This has the consequence that the crushing rolls take up heat by contact and thermal conduction from the material to be cooled. Furthermore, heat is also carried away by radiant heat exchange, since the rolls above the starting region of the material bed 3 form a comparatively large area at lower temperature. The large total area over which the crushing elements extend is a particular feature of the solution according to the invention. The resulting effective participation in radiant heat exchange with the material is therefore an additional advantage of the invention.

We claim:

1. Arrangement for crushing and cooling material passing out of a firing oven (4), including a cooler having a cooling bed spaced from the oven, a material path extending from the oven toward the cooling bed for free flow of the material therealong, said path having a high temperature inlet area immediately adjacent the oven and spaced from the cooling bed, and a material crusher (6) arranged in the high temperature inlet area within the free flow path of the material upstream of the cooling bed, characterized in that the crusher (6) comprises a plurality of roll-like crushing elements (7) mounted overhung on support means positioned outside the path (5) of the material, the crushing elements projecting into said path and each element being able to travel individually and selectively toward and away from a retracted position out of said path.

2. Arrangement according to claim 1 characterized in that the support means include bearing devices (11) operatively appended to individual crushing elements, said bearing elements together with the appertaining crushing elements (7) being able to travel individually in a longitudinal direction toward and away from a retracted position out of said path.

3. Arrangement according to claim 2 including shielding means for separating the bearing devices from the material path.

4. Arrangement according to claim 3 wherein said shielding means includes openings permitting retraction of the crushing elements from the material path.

5. Arrangement according to claim 1, characterized in that the individual crushing elements (7) are inclined relative to a horizontal position.

6. Arrangement according to claim 1, characterized in that individual crushing elements (7) are supported for different longitudinal travel toward and away from a retracted position.

7. Arrangement according to claim 1 characterized in that the oven is a rotary tubular oven (4) from which oversize material is discharged on one side of the material path and a majority of the crushing elements (7) are arranged on that side of the high temperature inlet area where the oversize particles predominantly occur.

8. Arrangement according to claim 1, characterized in that the crushing elements are rotatable and the speed of rotation of the crushing elements (7) is below 30 rpm.

9. Arrangement according to claim 1, characterized in that the crushing elements are rotatable and the speed of rotation of the individual crushing elements is adjustable, independently of one another.

10. Arrangement according to claim 1, characterized in that the crushing elements are rotatable and the direction of rotation of the crushing elements (7) is adjustable.

11. Arrangement according to claim 1, characterized in that the inlet area includes an inlet shaft and the crushing rolls (7) are provided only in a part of the cross-section of the inlet shaft, while the other part of the shaft is free from crushing elements for the flow of cooling air from the cooling bed to the oven (4).

12. Arrangement according to claim 1, characterized in that one or more of the crushing elements is movable in a transverse direction relative to said path.

* * * * *